US006237348B1

(12) United States Patent
Ide et al.

(10) Patent No.: US 6,237,348 B1
(45) Date of Patent: May 29, 2001

(54) PROCESS FOR TRANSFERRING LIQUEFIED GASES BETWEEN CONTAINERS

(75) Inventors: Satoshi Ide; Masayoshi Imoto; Takashi Shibanuma, all of Settsu (JP)

(73) Assignee: Daikin Industries, Ltd. (JP)

( * ) Notice: Subject to any disclaimer, the term of this patent is extended or adjusted under 35 U.S.C. 154(b) by 0 days.

(21) Appl. No.: 09/341,571

(22) PCT Filed: Jan. 8, 1998

(86) PCT No.: PCT/JP98/00044

§ 371 Date: Jul. 14, 1999

§ 102(e) Date: Jul. 14, 1999

(87) PCT Pub. No.: WO98/30833

PCT Pub. Date: Jul. 16, 1998

(30) Foreign Application Priority Data

Jan. 14, 1997 (JP) ..... 9-004366
Sep. 1, 1997 (JP) ..... 9-235711

(51) Int. Cl.[7] ..... F17C 7/02; F25B 45/00
(52) U.S. Cl. ..... 62/50.1; 62/149
(58) Field of Search ..... 62/50.1, 149

(56) References Cited

U.S. PATENT DOCUMENTS 5,643,492 * 7/1997 Shiflett ..... 252/67

FOREIGN PATENT DOCUMENTS 62-137497 6/1987 (JP) .
62-200099 9/1987 (JP) .
3-170585 7/1991 (JP) .
5-12261 3/1993 (JP) .
5-93198 4/1993 (JP) .
7-050640 * 11/1995 (JP) .
7-50640 11/1995 (JP) .
8-4997 * 1/1996 (JP) .

* cited by examiner

*Primary Examiner*—William Doerrler
(74) *Attorney, Agent, or Firm*—Larson & Taylor, PLC

(57) ABSTRACT

A liquefied gas is transfer filled by drawing out a nonazeotropic mixture stored in a first container and containing at least two liquefied gases differing in boiling point as essential components from a liquid phase thereof. The mixture is then transferred filled into a second container. The first container is filled with a supplement liquid or supplement gas in an amount making up for the portion of the capacity of the first container that is equal to the decrease in volume of the liquid phase of the nonazeotropic mixture resulting from transfer filling. The supplement liquid is the liquid phase of the liquefied gas mixture having the same composition as that of the nonazeotropic mixture stored in the first container. The supplement gas is a gaseous phase of a liquefied gas mixture having the same composition as that of the nonazeotropic mixture stored in the first container or a gaseous phase composed of at least one component of the nonazeotropic mixture and containing the component having the lowest boiling point of all of the components of the mixture in a proportion larger than the proportion in the nonazeotropic mixture. Alternatively, the supplement gas may be a compressed gas.

8 Claims, 3 Drawing Sheets

PROCESS FOR TRANSFERRING LIQUEFIED GASES BETWEEN CONTAINERS

TECHNICAL FIELD

The present invention relates to a method for transfer-filling of a mixture of substances used as a working fluid for a vapor compression type refrigeration cycle, particularly a nonazeotropic liquefied gas mixture comprising at least two liquefied gases differing in boiling point as essential components.

BACKGROUND ART

The vapor compression type refrigeration cycle in which a fluid is cooled or heated by utilizing changes in the state of substances, namely evaporation and condensation, is widely used in heating and cooling equipment, refrigerators, hot water supply systems, and other equipment. For such vapor compression type refrigeration cycles, various working fluids including fluorocarbon refrigerants have been developed and put to use. Among them, HCFC22 (monochlorodifluoromethane) is widely used in heating and cooling equipment for air conditioning.

However, in recent years, the comprehension has arisen that the release of chlorofluorohydrocarbons into the atmosphere would destroy the ozone layer of the stratosphere to thereby exert an annihilating influence on the ecosystem of the earth, inclusive of the human race. For that reason, it has already been internationally stipulated that the use of those substances should be restricted and, in the future, totally prohibited. Under the circumstances, it is an urgent mission to develop novel refrigerants free of risks for destruction of the ozonosphere.

Accordingly, a number of nonazeotropic mixed refrigerants has been proposed recently in an attempt to make up for characteristics which cannot be provided by any single refrigerant by using a mixture of refrigerants (e.g. Japanese Unexamined Patent Publications Nos. 79288/1989 and 287688/1991 and Japanese Examined Patent Publication No. 55942/1994).

In a phase change such as evaporation or condensation, a nonazeotropic mixture tends to readily allow evaporation of a component having a lower boiling point and condensation of a high-boiling component and thus undergo changes in composition. This tendency is more pronounced in the case of evaporation, namely phase change from liquid to vapor. The greater the difference in boiling point between constituents of the mixture is, the more remarkable said tendency is. Therefore, when such a nonazeotropic mixture is transferred from one container to another, it is common practice to draw out the mixture from the liquid phase in order to avoid the phase change. However, even when the liquid phase is withdrawn, the resulting reduction in pressure or expansion of the gaseous phase causes evaporation of the lower-boiling component in the liquid phase. Where the difference in boiling point between the components of the mixture is great, a change in composition amounting to about several percent may readily result.

However, even when the change in composition is of the order of several percent, a marked change in refrigerant performance occurs, with a decrease in refrigerating capacity or efficiency and, in addition, the safety features of the refrigerant, for example the combustibility, are greatly influenced.

Therefore, there has been proposed a method for transfer-filling a nonazeotropic mixture without a compositional alteration that may arise from transfer-filling which method comprises drawing out, for transfer-filling into a second container, the liquid phase of a nonazeotropic mixture from a first container containing said mixture, under pressurization of said first container from the vapor phase side thereof using a low-boiling liquefied gas which is the lowest-boiling component of said nonazeotropic mixture or a mixture composed exclusively of the same liquefied gas components as those of said nonazeotropic mixture and having a vapor pressure corresponding to at least 1.1 times as high as the vapor pressure of said nonazeotropic mixture at 20° C., or using a compressed gas (cf. Japanese Unexamined Patent Publication No. 4997/1996). However, this method is disadvantageous in that the proportion of the low-boiling component increases upon excessive pressurization with the low-boiling liquefied gas or compressed gas.

DISCLOSURE OF THE INVENTION

Figure 1:
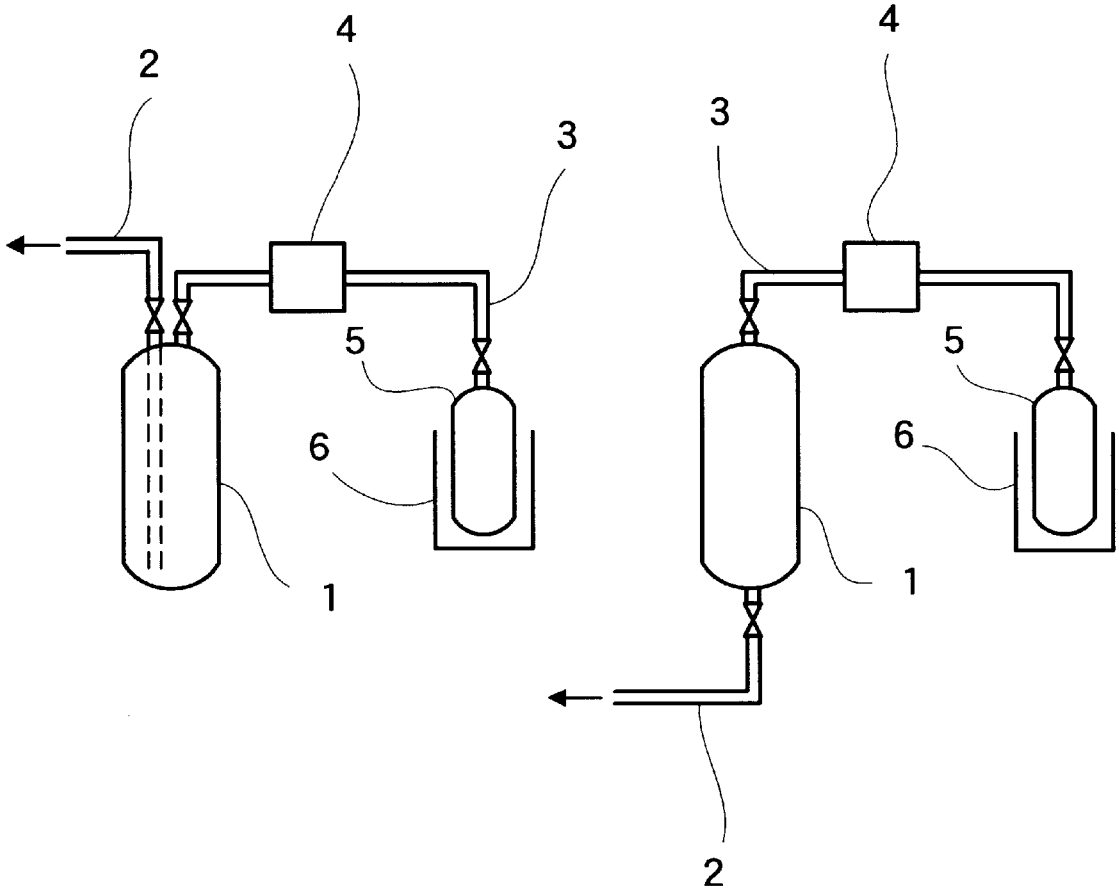
FIG. 1 is a schematic representation of the liquefied gas transfer-filling system of the present invention.

The primary object of the present invention is to provide a method for transfer-filling a nonazeotropic liquefied gas mixture which will cause little or no change in composition of the mixture.

The present inventors made an intensive investigation into the art of transfer-filling liquefied gases for solving the problem of a change in composition arising on the occasion of transfer-filling of a nonazeotropic mixture of at least two liquefied gases differing in boiling point as stored in a first closed container to a second container from the liquid side of said mixture. As the result of an effort made to improve the pressurization method described in Japanese Unexamined Patent Publication No. 4997/1996, the inventors found that when (A) a supplement liquid which is the liquid phase of a mixture having the same composition as that of the nonazeotropic mixture stored in the first container or (B) a supplement gas which is (i) (a) the gaseous phase of a liquefied gas mixture having the same composition as that of the nonazeotropic mixture stored in the first container or (b) a gaseous phase composed of at least one component of said nonazeotropic mixture and containing the component having the lowest boiling point of all the components thereof in a proportion larger than the proportion thereof in said nonazeotropic mixture or (ii) a compressed gas is injected into the first container at a rate necessary to make up for a portion of the capacity of the first container that is equal to the decrease in volume of the liquid phase of the nonazeotropic liquefied gas mixture to be subjected to transfer-filling, the change in composition of the nonazeotropic mixture as resulting from transfer-filling can be minimized. Based on this finding, the present invention has been completed.

The present invention thus provides the following technology:

1. A method for transfer-filling a liquefied gas by drawing out a nonazeotropic mixture stored in a first container and containing at least two liquefied gases differing in boiling point as essential components from a liquid phase thereof and transfer-filling the mixture into a second container, characterized in that the method comprises filling the following supplement liquid (A) or supplement gas (B) into said first container in an amount making up for a portion of the capacity of said first container that is equal to the decrease in volume of the liquid phase of said nonazeotropic mixture resulting from transfer-filling:

(A) a supplement liquid which is the liquid phase of a liquefied gas mixture having the same composition as that of the nonazeotropic mixture stored in the first container;

(B) a supplement gas which is (i) (a) a gaseous phase of a liquefied gas mixture having the same composition as that of the nonazeotropic mixture stored in the first container or (b) a gaseous phase composed of at least one component of said nonazeotropic mixture and containing the component having the lowest boiling point of all the components of said mixture in a proportion larger than the proportion thereof in said nonazeotropic mixture or (ii) a compressed gas.

2. A method as described above under 1, wherein, in drawing out a nonazeotropic mixture stored in a first container and containing at least two liquefied gases differing in boiling point as essential components from the liquid phase thereof and transfer-filling the mixture into a second container, the liquid phase of a liquefied gas mixture stored in a premixing tank and having the same composition as that of the nonazeotropic mixture stored in said first container is drawn out from said premixing tank and said liquid phase is filled into said first container in an amount making up for a portion of the capacity of said first container that is equal to the decrease in volume of the liquid phase of said liquefied nonazeotropic gas mixture resulting from transfer-filling.

3. A method as described above under 1 or 2 which comprises:

(i) a step which comprises preparing a nonazeotropic mixture by mixing at least two liquefied gases differing in boiling point in a first container, (ii) a step which comprises preparing, simultaneously with said step (i) or before or after said step (i), a liquefied gas mixture having the same composition as that of the nonazeotropic mixture stored in the first container, in a premixing tank, (iii) a step which comprises transfer-filling the nonazeotropic mixture in said first container to a second container, and (iv) a step which comprises filling the liquid phase of the mixture in the premixing tank into the first container simultaneously with said step (iii) or after partial transfer-filling of the nonazeotropic mixture in said step (iii) in an amount making up for a portion of the capacity of the first container that is equal to the decrease in volume of the liquid phase of said nonazeotropic mixture resulting from transfer-filling.

4. A method as described above under 1, wherein the first container is pressurized from the gaseous phase side with the supplement gas by introducing the supplement gas into the first container at a feeding rate necessary to, under the pressure of the gaseous phase, make up for a portion of the capacity of the first container that is equal to the decrease in volume of the liquid phase of said nonazeotropic mixture resulting from transfer-filling.

5. A method as described above under 4, wherein the supplement gas is filled into the first container under pressure from the gaseous phase side of said first container at a pressure corresponding to 1.03 to 1.10 times the vapor pressure of the nonazeotropic mixture to be transfer-filled.

6. A method as described above under 1, 4, or 5, wherein, in drawing out a nonazeotropic mixture stored in the first container and containing at least two liquefied gases differing in boiling point as essential components from the liquid phase thereof and transfer-filling the mixture into a second container, the gaseous phase of a liquefied gas, which is either a liquefied gas mixture having the same composition as that of the nonazeotropic mixture stored in the first container or a liquefied gas composed of at least one component of said nonazeotropic mixture and containing the component having the lowest boiling point of all the components of said mixture in a proportion larger than the proportion thereof in said nonazeotropic mixture, is drawn out from the premixing tank and filled into the first container in an amount making up for a portion of the capacity of the first container that is equal to the decrease in volume of the liquid phase of said nonazeotropic mixture resulting from transfer-filling.

7. A method as described above under 1, 4, 5 or 6 which comprises:

(i) a step which comprises preparing a nonazeotropic mixture by mixing at least two liquefied gases differing in boiling point in a first container, (ii) a step which comprises preparing, simultaneously with said step (i) or before or after said step (i), a liquefied gas, which is either a liquefied gas mixture having the same composition as that of the nonazeotropic mixture in the first container or a liquefied gas composed of at least one component of said nonazeotropic mixture and containing the component having the lowest boiling point of all the components of said mixture in a proportion larger than the proportion thereof in said nonazeotropic mixture, in a premixing tank, (iii) a step which comprises transfer-filling the nonazeotropic mixture in the first container to a second container, and (iv) a step which comprises filling the gaseous phase in the premixing tank into the first container, simultaneously with said step (iii) or after transfer-filling of part of the nonazeotropic mixture in said step (iii), in an amount making up for a portion of the capacity of the first container that is equal to the decrease in volume of the liquid phase of said nonazeotropic mixture resulting from transfer-filling.

8. A method as described above under 1, 4, 5, 6 or 7, wherein the method is practiced under the condition that a substance insoluble in the nonazeotropic mixture stored in the first container is disposed in the form of a layer on top of said mixture.

9. A method as described above under any of 1 through 8, wherein the nonazeotropic mixture stored in the first container is a mixture of difluoromethane and 1,1,1,2-tetrafluoroethane, a mixture of difluoromethane, pentafluoroethane and 1,1,1,2-tetrafluoroethane, a mixture of pentafluoroethane, 1,1,1-trifluoroethane and 1,1,1,2-tetrafluoroethane, a mixture of trifluoromethane, difluoromethane and 1,1,1,2-tetrafluoroethane, a mixture of difluoromethane and pentafluoroethane, or a mixture of chlorodifluoromethane, 1,1,1-trifluoroethane and pentafluoroethane.

10. A method as described above under 9, wherein the nonazeotropic mixture stored in the first container is a mixture composed of 23% by weight of difluoromethane, 25% by weight of pentafluoroethane and 52% by weight of 1,1,1,2-tetrafluoroethane, a mixture composed of 44% by weight of pentafluoroethane, 52% by weight of 1,1,1-trifluoroethane and 4% by weight of 1,1,1,2-tetrafluoroethane, or a mixture composed of 47% by weight of chlorodifluoromethane, 46% by weight of 1,1,1-trifluoroethane and 7% by weight of pentafluoroethane.

In the present invention, there is no particular limitation on the first container for storing the nonazeotropic mixture and the second container to be transfer-filled with said nonazeotropic mixture provided that they are gastight.

The nonazeotropic mixture, which is to be transfer-filled in accordance with the present invention, is a nonazeotropic mixture of at least two different liquefied gases selected from the group consisting of the so-called fluorohydrocarbons, such as fluorohydrocarbons and chlorofluorocarbons which are derived from hydrocarbons such as methane, ethane, or propane by partial substitution of either fluorine or fluorine and chlorine for the hydrogen atom or atoms thereof and have boiling points within the range of −85° to 40° C. at atmospheric pressure.

The liquefied gas mentioned above includes, but is not limited to, trifluoromethane (HFC23) (boiling point −82° C.), difluoromethane (HFC32) (boiling point −52° C.), monofluoromethane (HFC41) (boiling point −79° C.), pentafluoroethane (HFC125) (boiling point −49° C.), 1,1,2,2-tetrafluoroethane (HFC134) (boiling point −20° C.), 1,1,1,2-tetrafluoroethane (HFC134*a*) (boiling point −26° C.), 1,1,2-trifluoroethane (HFC143) (boiling point 5° C.), 1,1,1-trifluoroethane (HFC143*a*) (boiling point −48° C.), 1,2-difluoroethane (HFC152) (boiling point 31° C.), 1,1-difluoroethane (HFC152*a*) (boiling point −25° C.), monofluroethane (HFC161) (boiling point −37° C.), 1,1,1,2,2,3,3-heptafluoropropane (HFC227*ca*) (boiling point −15° C.), 1,1,1,2,3,3,3-heptafluoropropane (HFC227*ea*) (boiling point −15° C.), 1,1,1,2,3,3-hexafluoropropane (HFC236*ea*) (boiling point 6° C.), 1,1,2,2,3-pentafluoropropane (HFC245*ca*) (boiling point 25° C.), 1,1,1,3,3-pentafluoropropane (HFC245*fa*) (boiling point 15° C.), chlorodifluoromethane (HCFC22) (boiling point −41° C.), 1,1-dichloro-2,2,2-trifluoroethane (HCFC123) (boiling point 27° C.) 1-chloro-1,2,2,2-tetrafluoroethane (HCFC124) (boiling point −10° C.), 1,1-dichloro-1-fluoroethane (HCFC141*b*) (boiling point 32° C.), and 1-chloro-1,1-difluoroethane (HCFC142*b*) (boiling point −10° C.). Two or more of these gases are used.

Suitable examples of the nonazeotropic mixture to which the present invention can be applied with advantage are (a) a mixture of difluoromethane and 1,1,1,2-tetrafluroethane, (b) a mixture of difluoro-methane, pentafluoroethane and 1,1,1,2-tetrafluroethane, (c) a mixture of pentafluoroethane, 1,1,1-trifluoroethane and 1,1,1,2-tetrafluroethane, (d) a mixture of trifluoromethane, difluoromethane and 1,1,1,2-tetrafluroethane, (e) a mixture of difluoromethane and pentafluoroethane, and (f) a mixture of chlorodifluoromethane, 1,1,1-trifluoroethane and pentafluoroethane, among other mixtures.

The proportions of the respective component of the above mixtures are not limited but may vary according to the combination of the components. As typical specific nonazeotropic mixtures which are particularly suited for the purpose of the present invention, there may be mentioned (a) a mixture (R407C) of 23% by weight of difluoromethane, 25% by weight of pentafluoroethane and 52% by weight of 1,1,1,2-tetrafluoroethane, (b) a mixture (R404A) of 44% by weight of pentafluoroethane, 52% by weight of 1,1,1-trifluoroethane and 4% by weight of 1,1,1,2-tetrafluoroethane, and (c) a mixture (R408A) of 47% by weight of chlorodifluoromethane, 46% by weight of 1,1,1-trifluoroethane and 7% by weight of pentafluoroethane, among others.

According to the method of the present invention, in drawing out a nonazeotropic mixture stored in a first container and containing at least two liquefied gases differing in boiling point as essential components from the liquid phase thereof and then transferring and filling the mixture into a second container, the supplement liquid (A) or supplement gas (B) mentioned below is introduced into the first container in an amount making up for a portion of the capacity of the first container that is equal to the decrease in volume of the liquid phase of the nonazeotropic mixture resulting from transfer-filling:

(A) the liquid phase of a liquefied gas mixture having the same composition as that of the nonazeotropic mixture stored in the first container;

(B) (i) (a) the gaseous phase of a liquefied gas mixture having the same composition as that of the nonazeotropic mixture stored in the first container or (b) a gaseous phase composed of at least one component of said nonazeotropic mixture and containing the component having the lowest boiling point of all the components of said nonazeotropic mixture in a proportion larger than the proportion thereof in said nonazeotropic mixture, or (ii) a compressed gas.

In practicing the mode which comprises introducing the liquid (A), among the above-mentioned modes, for supplementation, the liquid phase of a nonazeotropic mixture having the same composition as the nonazeotropic mixture stored in the first container is used and this liquid phase is continuously or intermittently fed into the first container in such a manner that it makes up for a portion of the capacity of the first container that is equal to the decrease in volume of the liquid phase of the nonazeotropic mixture resulting from transfer-filling. For this purpose, the first container is preferably provided with a level gauge so as to set the amount of feeding according to the change of the liquid level in the first container. In the case of intermittent feeding, the feeding should be made at intervals such that no substantial change will occur in the composition of the nonazeotropic mixture. The interval between feedings varies with different compositions of the nonazeotropic mixture. Generally, however, each feeding is preferably performed before the decrease of the liquid in the first container amounts to about 10 to 30% by volume.

When the mode of feeding the supplement gas (B) is employed, the gas to be fed is (i) (a) the gaseous phase of a liquefied gas mixture having the same composition as that of the nonazeotropic mixture stored in the first container or (b) a gaseous phase composed of at least one component of said nonazeotropic mixture and containing the component having the lowest boiling point of all the components of said mixture in a proportion larger than the proportion thereof in said nonazeotropic mixture, or (ii) a compressed gas. The gas is introduced under pressure from the gaseous phase side of the first container.

Referring to the supplement gases (B), the gaseous phase (i) (b) is only required to consist of at least one component of said nonazeotropic mixture and contain the component having the lowest boiling point of all the components of said mixture in a proportion larger than the proportion thereof in said nonazeotropic mixture. The proportion of the lowest-boiling component is preferably as high as possible and said gaseous phase may even consist in a single component. Preferred examples of the combination of nonazeotropic mixture and mixture (i) (b) are as follows.

| Nonazeotropic mixture | Mixture (i) (b) |
|---|---|
| R407C | HFC32 (40–60 wt %) + HFC125 (60–40 wt %) |
| R4D4A | HFC125 (40–60 wt %) + HFC143a (60–40 wt %) |
| R408A | HFC125 (40–60 wt %) + HFC143a (60–40 wt %) |

The compressed gas (ii) that can be used includes, but is not limited to, nitrogen, helium, argon, and air.

When the mode of feeding the supplement gas is used, the rate of flow of the pressurizing gas, that is said supplement gas (i) or (ii), as introduced from the gaseous phase side of the first container is preferably so controlled that the decrease in volume of the liquid phase of the nonazeotropic liquefied gas in the first container, which is being transferred, is compensated for by said supplement gas under the pressure of the gaseous phase. For that purpose, the actual pressure to be applied is appropriately 1.03 to 1.10 times the vapor pressure of said nonazeotropic mixture. Outside this range, it will be difficult to maintain the balance between said pressure and the rate of flow for transfer-filling or, in other words, to keep the composition constant. The technology for pressurization for that purpose is not limited to any particular method but, for example, pressurization by warming or by means of a pump, pressure adjustment using a pressure reducing valve or the like means may be employed.

In accordance with the present invention, it is also possible to carry out the transfer-filling by using said supplement gas under the condition that a substance insoluble in the nonazeotropic mixture is disposed in the form of a layer on top of the nonazeotropic mixture in the first container. In this mode of practice, the insoluble substance layer prevents the pressurizing gas from contacting with said nonazeotropic mixture directly, whereby the dissolution of the pressurizing gas is prevented and the change in composition can be further diminished.

The substance to be superimposed in the form of a layer on the nonazeotropic mixture in the first container is not particularly limited in kind provided that it is a substance insoluble in said nonazeotropic mixture and has a low specific gravity. Thus, any of mineral oil, synthetic oil, resin, rubber, metal, etc. can be used for this purpose.

The transfer-filling method according to the present invention is now described in detail, referring to the accompanying drawings.

FIG. 1 is a schematic representation of the mode of introducing a supplement gas into a first container in the liquefied gas transfer-filling system according to the present invention. In the figure, the reference numeral (1) represents a first container to be filled with the liquefied gas, (2) a draw-out piping on the liquid side, (3) a piping for pressurization on the vapor side, (4) a pressure regulating valve, (5) a pressurizing gas container, and (6) a constant-temperature bath.

The first container 1 is filled with said nonazeotropic mixture composed of at least two liquefied gases differing in boiling point. A mixed gas having the same composition as that of said nonazeotropic mixture or a mixed gas containing the same low-boiling component as that contained in said nonazeotropic mixture but having a higher vapor pressure is fed to the pressurizing gas container 5 and warmed in the constant-temperature bath 6. On the occasion of transfer-filling of the liquefied gas from the draw-out piping 2 on the liquid side by opening an associated valve, the first container 1 is simultaneously pressurized from the vapor side with the pressurizing gas from the pressurizing gas container 5 through the vapor-side piping 3 while the pressurizing gas pressure is adjusted by means of the pressure regulating valve 4.

When the pressurizing gas is a liquefied gas, the volumetric proportions of the capacity of the first container 1 and the amount of the pressurizing gas present in the pressurizing gas container 5 may be set somewhere between the critical limit not causing exhaution of the liquid phase due to pressurization and the critical limit not causing a change in composition of the pressurizing gas. Generally, the preferred ratio of the pressurizing gas volume to the capacity of the first container is about 1/10 to 1/2.

Preferred embodiments of the transfer-filling method of the present invention are now described in further detail referring to the drawings.

Figure 2:
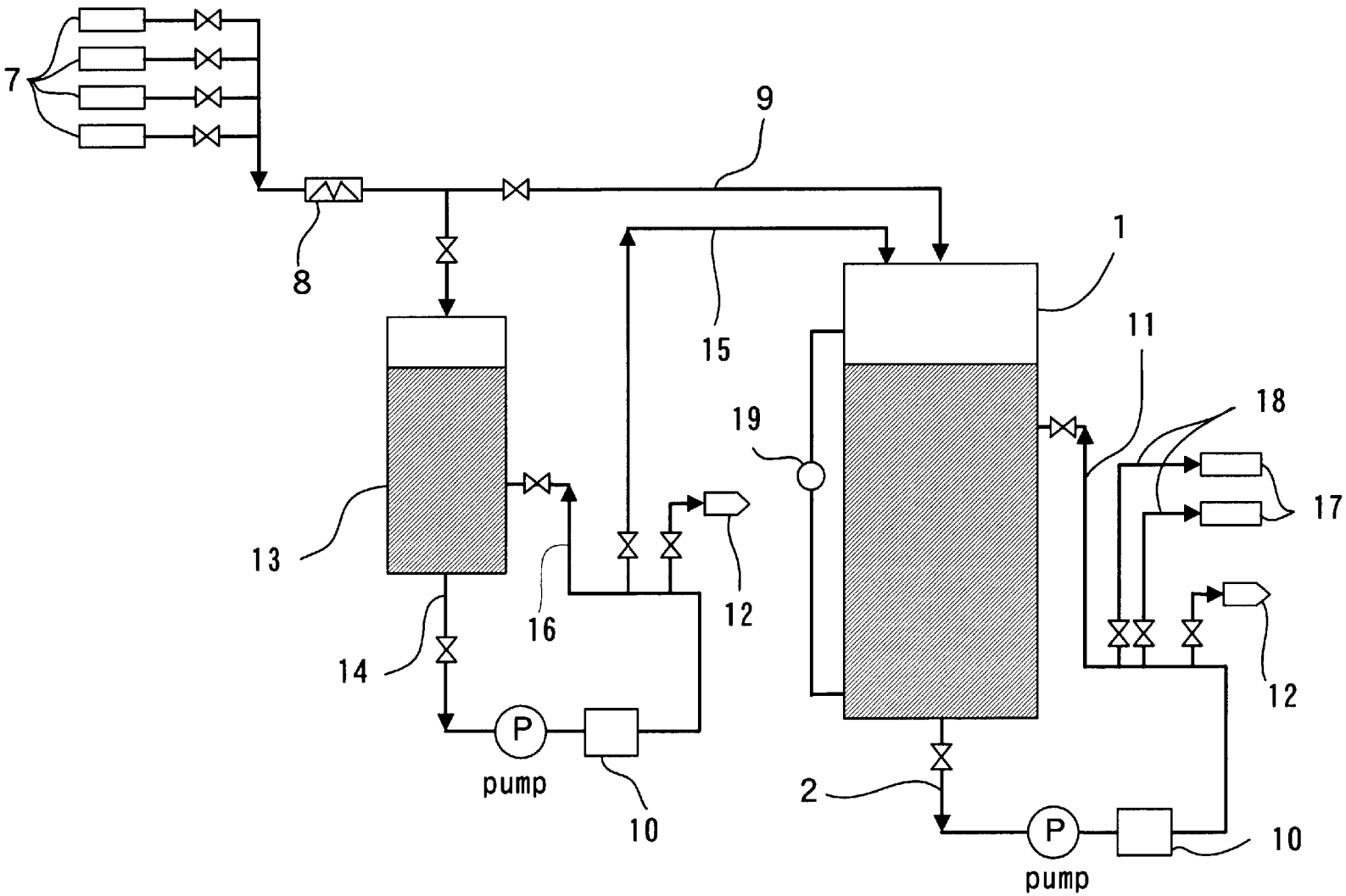
FIG. 2 is a schematic representation of an example of the mode of supplemental feeding of the liquid phase of a nonazeotropic mixture into the first container.

FIG. 2 is a schematic representation of the typical system for introducing a nonazeotropic mixture in liquid form into the first container on the occasion of transfer-filling. In the figure, (1) represents a first container to be filled with a liquefied gas, (2) a liquid draw-out piping belonging to the first container, (7) raw material storage containers, (8) a premixer, (9) a piping for liquid, (10) a cooling means, (11) a piping for liquid circulation for the first container, (12) an analytical means, (13) a premixing tank, (14) a liquid draw-out piping belonging to the premixing tank, (15) a supplement liquid feed line, (16) a liquid circulation piping belonging to the premixing tank, (17) a second container into which the liquefied gas is to be transfer-filled, (18) a piping for transfer-filling, and (19) a level gauge.

The raw material storage containers (7) are filled with the corresponding raw material liquefied gases to be used as constituents of the nonazeotropic mixture. Specified amounts of those raw material liquefied gases are fed to the premixer 8 in which they are mixed. The resulting mixture is fed through the liquid line 9 to the first container 1, where further mixing is done. The resulting mixture is stored in the first container 1 as a nonazeotropic mixture having a specified composition. This nonazeotropic mixture is preferably maintained within a temperature range causing little change in composition, as necessary, by extracting it out through the draw-out piping 2, cooling the same in the cooling means 10, for example a cooling condenser, and recycling it to the first container 1 via the liquid circulation piping 11. For this purpose, it is desirable to provide a temperature monitor (not shown) at an appropriate site of the first container 1. Furthermore, the composition of the mixture in the first container 1 is preferably checked, as necessary, at regular intervals by analytical means 12, for example, a gas chromatograph.

On the other hand, a supplement liquid is prepared, at an arbitrarily selected time, namely simultaneously with the step of preparing the nonazeotropic mixture in first container 1 or before or after said step, by feeding the raw material liquefied gases, each in a specified amount, to the premixer 8 from the raw material containers 7, for mixing up to give the same composition as the nonazeotropic mixture in the first container 1. This mixture is used for supplemental feeding into the first container 1. On that occasion, although the supplement liquid made up in the premixer 8 may be directly introduced into the first container 1 via the liquid line 9, the method is preferred which comprises feeding the supplement liquid made up in premixer 8 to the premixing tank 13 and, after mixing up therein, drawing out the mixture via the liquid draw-out piping 14 belonging to premixing tank 13, and injecting the same into the first container 1 via the supplement liquid feeding line 15. In this method, it is possible to correctly prepare a mixture having the same composition as that of the nonazeotropic mixture in the first container 1 by confirming, as necessary, the composition after thorough mixing of the respective components in the premixing tank 13 by the analytical means 12, for example a gas chromatograph and, hence, it is possible to substantially prevent alteration in composition of the nonazeotropic mixture on the occasion of injecting the supplement liquid into the first container 1. The nonazeotropic mixture in the premixing tank 13 is preferably maintained within a temperature range inducing little change in its composition by providing a temperature monitor (not shown) at an appropriate site of the premixing tank 13 and, as necessary, drawing out the mixture via the draw-out piping 14, cooling the same in the cooling means 10, for example a cooling condenser, and recycling the same to the premixing tank 13 via the liquid circulation piping 16.

On the occasion of transferring and filling the nonazeotropic mixture from the first container 1 to a second container 17 in the transfer-filling system shown in FIG. 2, the nonazeotropic mixture drawn out from the first container 1 via the liquid draw-out piping 2 is transferred and filled into a container for transfer-filling (second container) 17 via the transfer-filling line 18 and, simultaneously or after partial transfer-filling the supplement liquid drawn out from the premixing tank 13 via the liquid draw-out piping 14 is injected, via the supplement feed piping 15, into the first container 1, in an amount corresponding to the decrease in liquid volume of the nonazeotropic mixture in first container 1. For this purpose, it is desirable to provide the first container 1 with a level gauge 19 to thereby monitor the volume of the liquid phase of the nonazeotropic mixture in the first container 1 and inject the supplement liquid in an amount corresponding to the decrease of said volume continuously or intermittently from the premixing tank 13 into the first container 1. Further, it is desirable to provide the premixing tank 13 with an appropriate level gauge, a weight measuring means and so on (not shown) to maintain the liquid volume at or above a predetermined level.

Figure 3:
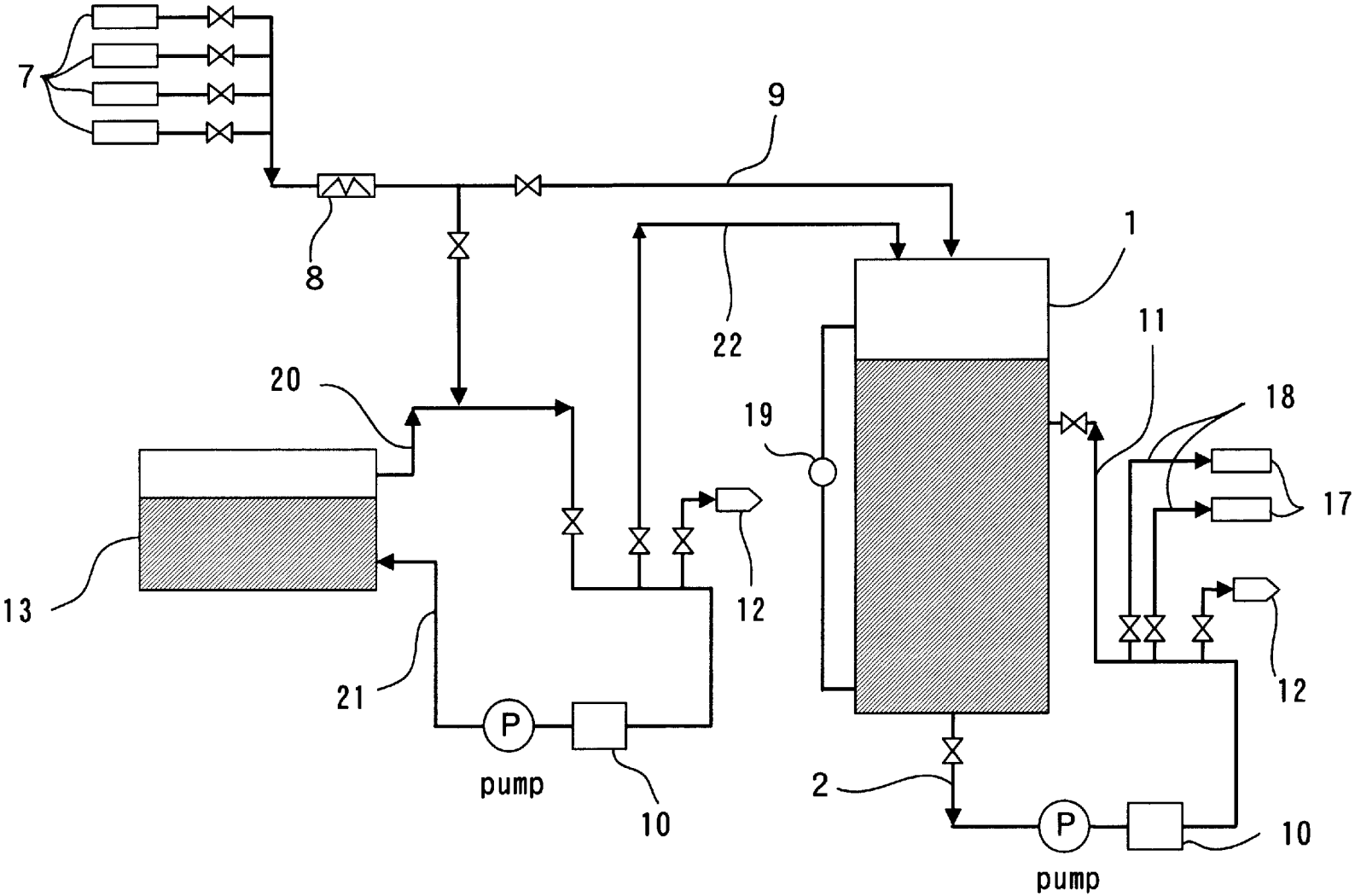
FIG. 3 is a schematic representation of an example of the mode of supplemental feeding of the gaseous phase of a nonazeotropic mixture into the first container. In the figures, the reference numeral 1 stands for the first container for liquified gas, 2 for a liquid side draw-out piping, 3 for a piping for pressurization on the vapor side, 4 for a pressure regulating valve, 5 for a gas container for pressurization, 6 for a constant-temperature bath, 7 for a container for storing a component of the mixture, 8 for a premixer, 9 for a liquid transfer piping, 10 for a cooling means, 11 for a piping for circulating the liquid in the first container, 12 for an analytical means, 13 for a premixing tank, 14 for a liquid draw-out piping for the premixing tank, 15 for a piping for injecting a supplement liquid, 16 for a liquid circulation piping for the premixing tank, 17 for a second container, 18 for a piping for transfer-filling, 19 for a level gauge, 20 for a gas draw-out piping for the premixing tank, 21 for a gas circulation piping for the premixing tank, and 22 for a piping for injecting a supplement gas.

FIG. 3 is a schematic representation of an example of the mode of injecting the gaseous phase of a liquefied gas into the gaseous phase in the first container on the occasion of transfer-filling. In the figure, the reference numeral (20) represents a gas draw-out piping belong to the premixing tank, (21) a gas circulation piping belonging to the premixing tank, and (22) a supplement gas feed line. The other reference numerals respectively have the same meanings as in FIG. 2.

The method of mixing up the raw material liquefied gases for preparing said nonazeotropic mixture and storing the mixture in the first container 1 may be the same as in the method described referring to FIG. 2.

The gas for supplementation is prepared, at an arbitrarily selected time, namely simultaneously with the step of preparing the nonazeotropic mixture in the first container or before or after said step, by feeding the raw material liquefied gases, in amounts respectively specified to give a liquefied gas mixture having the same composition as that of the nonazeotropic mixture in the first container 1 or a liquefied gas composed of at least one component of said nonazeotropic mixture and containing the component having the lowest boiling point of all the components of said mixture in a proportion larger than the proportion thereof in said nonazeotropic mixture, to the premixer 8 from the raw material container 7 and, after mixing in the premixer 8, feeding the resulting mixture to the premixing tank 13. In the premixing tank 13, a mixture having the specified composition is correctly prepared by uniformly mixing the respective components and then confirming, as necessary, the composition using the analytical means 12, for example a gas chromatograph. It is desirable that, in the premixing tank 13, a temperature range where the composition change is little be maintained by drawing out, as necessary, the gaseous phase via the gas draw-out piping 20 under monitoring with a suitable temperature monitor (not shown), cooling the same in the cooling means 10, for example a cooling condenser, and recycling the same through the gas circulation piping 21 to the premixing tank 13 from the liquid phase side thereof.

On the occasion of transferring and filling the nonazeotropic mixture from the first container 1 to the second container 17 in the transfer-filling system shown in FIG. 3, the nonazeotropic mixture drawn out from the first container 1 via the liquid draw-out piping 2 is transferred and filled into a predetermined tank (second container) 17 via the transfer-filling line 18 and, simultaneously or after partial transfer-filling, the supplement gas drawn out from the premixing tank 13 via the gas draw-out piping 20 disposed on the gaseous phase side of the premixing tank 13 is injected into the first container 1 on the gaseous phase side thereof via the supplement gas injection piping 22, at a rate such that the decrease in volume of the liquid phase in the first container 1 is compensated for by said supplement gas under the pressure of the gaseous phase. The gaseous phase in the premixing tank 13 is used as the supplement gas. This gaseous phase may be the gas produced by forced evaporation of the liquid phase in the premixing tank 13, for example by heating. The pressure of the gas in the premixing tank 13 is adjusted to a predetermined level by warming, compression using a boosting pump, pressure adjustment using a pressure reducing valve or the like technique.

In this method, as in the method shown in FIG. 2, it is desirable that the first container 1 be provided with a level gauge 19 to monitor the volume of the liquid phase of the nonazeotropic mixture in the first container 1, so that the supplement gas can be injected continuously or intermittently into the first container 1 from the premixing tank 13 in an amount corresponding to the decrease in liquid volume in first container 1. Further, it is desirable that the premixing tank 13 be provided with an appropriate level gauge, weight measuring means, and/or the like (not shown) to thereby maintain the amount of the liquid phase at or above a predetermined level.

According to the technology of the present invention, the change in composition on the occasion of transfer-filling of a nonazeotropic mixture of refrigerants used as a working fluid in the vapor compression type refrigeration cycle can be markedly reduced, with the result that the reduction in refrigerant performance and the combustion risk thereof can be successfully prevented.

BEST MODES FOR CARRYING OUT THE INVENTION

The following examples and comparative examples illustrate the present invention in further detail. The scope of the invention should by no means be construed as being limited to the examples insofar as not departing from the scope of the appended claims.

EXAMPLE 1 and Comparative EXAMPLE 1

A 2.25-liter container (hereinafter referred to as "first container") was filled with 2 kg of a nonazeotropic mixture of difluoromethane (HFC32), pentafluoroethane (HFC125) and 1,1,1,2-tetrafluroethane (HFC134*a*) in a weight ratio of 23/25/52, and a one-liter pressurizing tank was filled with 800 g of a nonazeotropic mixture of HFC32, HFC125 and HFC134*a* in a weight ratio of 23/25/52. For increasing the vapor pressure, the vapor side of the first container was connected to the vapor side of the pressurizing tank via a piping, and a flow meter was provided for flow rate measurement. While warming the pressurizing tank at 30° C. in a constant-temperature bath, the first container was further pressurized by 0.08 MPa from the vapor side thereof using a pressure regulating valve and, at the same time, the nonazeotropic mixture was transferred and filled into another empty container at a rate of 12 grams per minute from the liquid side of the first container using a pump. The transfer-filling was performed at room temperature. A portion of the gas during transfer-filling was collected via a sampling valve disposed in an intermediate position of the liquid side draw-out piping and analyzed for composition by gas chromatography. The rate of flow of the pressurizing gas was about 10.6 $cm^3$ per minute.

In Comparative Example 1, transfer-filling was carried out in the same manner while the piping on the vapor side of the first container was closed.

The percentage transfer-filling rates and the results of composition analysis of the gas samples taken are shown in Table 1. The vapor pressure of HFC32/HFC125/HFC134*a* (23/25/52 wt %) at 25° C. was 1.21 MPa and the vapor pressure at 30° C. was 1.37 MPa.

TABLE 1

| % Transfer filling | Composition (wt %) | | | | | |
|---|---|---|---|---|---|---|
| | Example 1 | | | Comparative Example 1 | | |
| | HFC32 | HFC125 | HFC134a | HFC32 | HFC125 | HFC134a |
| 0 | 23.0 | 25.0 | 52.0 | 23.0 | 25.0 | 52.0 |
| 10 | 23.0 | 25.0 | 52.0 | 23.0 | 25.0 | 52.0 |
| 20 | 23.0 | 25.0 | 52.0 | 22.9 | 24.9 | 52.2 |
| 30 | 23.0 | 25.0 | 52.0 | 22.8 | 24.9 | 52.3 |
| 40 | 23.0 | 25.0 | 52.0 | 22.7 | 24.8 | 52.5 |
| 50 | 23.0 | 25.0 | 52.0 | 22.6 | 24.8 | 52.6 |
| 60 | 23.0 | 25.0 | 52.0 | 22.5 | 24.7 | 52.8 |
| 70 | 23.0 | 25.0 | 52.0 | 22.4 | 24.6 | 53.0 |
| 80 | 23.0 | 25.0 | 52.0 | 22.2 | 24.4 | 53.4 |
| 90 | 23.3 | 25.1 | 51.6 | 21.7 | 24.0 | 54.3 |

EXAMPLE 2 and Comparative EXAMPLE 2

Using a mixture of HFC32, HFC125 and HFC134*a* in a weight ratio of 23/25/52 as the nonazeotropic mixture and a mixture of HFC32 and HFC125 in a weight ratio of 50/50 as the pressurizing gas, the pressure in the first container was further increased by 0.06 MPa and a test was performed in the same manner as in Example 1. The pressurizing gas had a sufficiently high pressure as shown below and, therefore, the warming in the constant-temperature bath was omitted. The rate of flow of the pressurizing gas was about 10.5 $cm^3$ per minute.

In Comparative Example 2, transfer-filling was carried out in the same manner while the piping on the vapor side of the first container was closed.

The percentage transfer-filling rates and the results of composition analysis of the gas samples taken are shown in Table 2. The vapor pressure of HFC32/HFC125/HFC134*a* (23/25/52 wt %) at 25° C. was 1.21 MPa and the vapor pressure of HFC32/HFC125 (50/50 wt %) at 25° C. was 1.66 MPa.

TABLE 2

| % Transfer filling | Composition (wt %) | | | | | |
|---|---|---|---|---|---|---|
| | Example 2 | | | Comparative Example 2 | | |
| | HFC32 | HFC125 | HFC134a | HFC32 | HFC125 | HFC134a |
| 0 | 23.0 | 25.0 | 52.0 | 23.0 | 25.0 | 52.0 |
| 10 | 23.0 | 25.0 | 52.0 | 23.0 | 25.0 | 52.0 |
| 20 | 23.0 | 25.0 | 52.0 | 22.9 | 24.9 | 52.2 |
| 30 | 23.0 | 25.0 | 52.0 | 22.8 | 24.9 | 52.3 |
| 40 | 23.0 | 25.0 | 52.0 | 22.7 | 24.8 | 52.5 |
| 50 | 23.0 | 25.0 | 52.0 | 22.6 | 24.8 | 52.6 |
| 60 | 23.0 | 25.0 | 52.0 | 22.5 | 24.7 | 52.8 |
| 70 | 23.0 | 25.0 | 52.0 | 22.4 | 24.6 | 53.0 |
| 80 | 23.0 | 25.0 | 52.0 | 22.2 | 24.4 | 53.4 |
| 90 | 22.9 | 24.9 | 52.2 | 21.7 | 24.0 | 54.3 |

As is evident from the data compiled in Table 1 and Table 2, it is possible, by pressurizing from the vapor side, to reduce the composition change drastically, i.e. to 1/12 to 2/12, as compared with the case where no pressurization is made.

EXAMPLE 3

According to the transfer-filling system shown in FIG. 2, the method of injecting a supplement liquid into a first container was carried out under the following conditions.

The first container with a capacity of 14.6 $m^2$. was filled with 14,000 kg of a nonazeotropic mixture (R407C) of HFC32, HFC125 and HFC134*a* in a weight ratio of 23/25/52 and the nonazeotropic mixture was transferred and filled from the liquid phase side of the first container into another empty container at a rate of 25 kg per minute.

Separately, a 2.2 $m^3$ premixing tank was filled with 2,000 kg of a mixture having the same composition as that of the nonazeotropic mixture filled into the first container. The first container was provided with a level gauge, and the nonazeotropic mixture in the premixing tank was drawn out from the liquid phase for feeding into the first container in an amount corresponding to the decrease in liquid volume in the first container, at each time when the decrease in amount of the liquid phase in first container amounted to 10% by volume.

During the above procedure, the mixture in the first container and the mixture in the premixing tank were each maintained at about 25° C. by cooling with cold water.

The mixture in the premixing tank was supplemented by feeding, via a premixer, the required amounts of raw material liquefied gases from the respective raw material storage containers.

Such transfer-filling was continuously repeated, and a portion of the nonazeotropic mixture during transfer-filling was taken out periodically via a sampling valve disposed in an intermediate position of the draw-out piping belonging to the first container and subjected to composition analysis by gas chromatography. No substantial change in composition was found, with the composition of the nonazeotropic mixture stored in the first container being successfully kept constant.

What is claimed is:

1. A method for transfer-filling a liquefied gas by drawing out a nonazeotropic mixture stored in a first container and containing at least two liquefied gases differing in boiling point as essential components from a liquid phase thereof and transfer-filling the mixture into a second container, characterized in that the method comprises filling the following supplement liquid (A) or supplement gas (B) into said first container in an amount making up for a portion of the capacity of said first container that is equal to the decrease in volume of the liquid phase of said nonazeotropic mixture resulting from transfer-filling, provided that, in the case of using the supplement gas (B), the supplement gas is filled into the first container under pressure from the gaseous phase side of said first container at a pressure corresponding to 1.03 to 1.10 times the vapor pressure of the nonazeotropic mixture to be transfer-filled:

(A) a supplement liquid which is the liquid phase of a liquefied gas mixture having the same composition as that of the nonazeotropic mixture stored in the first container;

(B) a supplement gas which is (i) (a) a gaseous phase of a liquefied gas mixture having the same composition as that of the nonazeotropic mixture stored in the first container or (b) a gaseous phase composed of at least one component of said nonazeotropic mixture and containing the component having the lowest boiling point of all the components of said mixture in a proportion larger than the proportion thereof in said nonazeotropic mixture or (ii) a compressed gas.

2. A method as claimed in claim 1, wherein, in drawing out a nonazeotropic mixture stored in a first container and containing at least two liquefied gases differing in boiling point as essential components from the liquid phase thereof and transfer-filling the mixture into a second container, the liquid phase of a liquefied gas mixture stored in a premixing tank and having the same composition as that of the nonazeotropic mixture stored in said first container is drawn out from said premixing tank and said liquid phase is filled into said first container in an amount making up for a portion of the capacity of said first container that is equal to the decrease in volume of the liquid phase of said liquefied nonazeotropic gas mixture resulting from transfer-filling.

3. A method as claimed in claim 1 which comprises:

(i) a step which comprises preparing a nonazeotropic mixture by mixing at least two liquefied gases differing in boiling point in a first container, (ii) a step which comprises preparing, simultaneously with said step (i) or before or after said step (i), a liquefied gas mixture having the same composition as that of the nonazeotropic mixture stored in the first container, in a premixing tank, (iii) a step which comprises transfer-filling the nonazeotropic mixture in said first container to a second container, and (iv) a step which comprises filling the liquid phase of the mixture in the premixing tank into the first container, simultaneously with said step (iii) or after partial transfer-filling of the nonazeotropic mixture in said step (iii), in an amount making up for a portion of the capacity of the first container that is equal to the decrease in volume of the liquid phase of said nonazeotropic mixture resulting from transfer-filling.

4. A method for transfer-filling a liquefied gas by drawing out a nonazeotropic mixture stored in a first container and containing at least two liquefied gases differing in boiling point as essential components from a liquid phase thereof and transfer-filling the mixture into a second container, characterized in that the first container is pressurized from the gaseous phase side with a supplement gas by introducing the supplement gas into the first container at a feeding rate necessary to, under the pressure of the gaseous phase, make up for a portion of the capacity of the first container that is equal to the decrease in volume of the liquid phase of said nonazeotropic mixture resulting from transfer-filling, said supplement gas being (i) (a) a gaseous phase of a liquefied gas mixture having the same composition as that of the nonazeotropic mixture stored in the first container or (b) a gaseous phase composed of at least one component of said nonazeotropic mixture and containing the component having the lowest boiling point of all the components of said mixture in a proportion larger than the proportion thereof in said nonazeotropic mixture or (ii) a compressed gas.

5. A method as claimed in claim 1, wherein, in drawing out a nonazeotropic mixture stored in the first container and containing at least two liquefied gases differing in boiling point as essential components from the liquid phase thereof and transfer-filling the mixture into a second container, the gaseous phase of a liquefied gas, which is either a liquefied gas mixture having the same composition as that of the nonazeotropic mixture stored in the first container or a liquefied gas composed of at least one component of said nonazeotropic mixture and containing the component having the lowest boiling point of all the components of said mixture in a proportion larger than the proportion thereof in said nonazeotropic mixture, is drawn out from a premixing tank and filled into the first container in an amount making up for a portion of the capacity of the first container that is equal to the decrease in volume of the liquid phase of said nonazeotropic mixture resulting from transfer-filling.

6. A method as claimed in claim 1 which comprises:

(i) a step which comprises preparing a nonazeotropic mixture by mixing at least two liquefied gases differing in boiling point in a first container, (ii) a step which comprises preparing, simultaneously with said step (i) or before or after said step (i), a liquefied gas, which is either a liquefied gas mixture having the same composition as that of the nonazeotropic mixture in the first container or a liquefied gas composed of at least one component of said nonazeotropic mixture and containing the component having the lowest boiling point of all the components of said mixture in a proportion larger than the proportion thereof in said nonazeotropic mixture, in a premixing tank, (iii) a step which comprises transfer-filling the nonazeotropic mixture in the first container to a second container, and (iv) a step which comprises filling the gaseous phase in the premixing tank into the first container, simultaneously with said step (iii) or after transfer-filling of part of the nonazeotropic mixture in said step (iii), in an amount making up for a portion of the capacity of the first container that is equal to the decrease in volume of the liquid phase of said nonazeotropic mixture resulting from transfer-filling.

7. A method as claimed in claim 1 wherein the nonazeotropic mixture stored in the first container is a mixture of difluoromethane and 1,1,1,2-tetrafluoroethane, a mixture of difluoromethane, pentafluoroethane and 1,1,1,2-tetrafluoroethane, a mixture of pentafluoroethane, 1,1,1-trifluoroethane and 1,1,1,2-tetrafluoroethane, a mixture of trifluoromethane, difluoromethane and 1,1,1,2-tetrafluoroethane, a mixture of difluoromethane and pentafluoroethane, or a mixture of chlorodifluoromethane, 1,1,1-trifluoroethane and pentafluoroethane.

8. A method as claimed in claim 7, wherein the nonazeotropic mixture stored in the first container is a mixture composed of 23% by weight of difluoromethane, 25% by weight of pentafluoroethane and 52% by weight of 1,1,1,2-tetrafluoroethane, a mixture composed of 44% by weight of pentafluoroethane, 52% by weight of 1,1,1-trifluoroethane and 4% by weight of 1,1,1,2-tetrafluoroethane, or a mixture composed of 47% by weight of chlorodifluoromethane, 46% by weight of 1,1,1-trifluoroethane and 7% by weight of pentafluoroethane.

* * * * *